US005397617A

United States Patent [19]

Chen

[11] Patent Number: 5,397,617

[45] Date of Patent: Mar. 14, 1995

[54] REFLECTIVE ROAD SIGN

[76] Inventor: Judy Chen, 2F, No.2, Alley 1, Lane 110, Chung-Cheng W. Rd., Chu-Pei City, Hsin-Chu Hsien, Taiwan, Prov. of China

[21] Appl. No.: 64,593

[22] Filed: May 21, 1993

[51] Int. Cl.[6] ..... B32B 3/02

[52] U.S. Cl. ..... 428/66; 428/64; 428/913; 359/515; 359/551; 404/9

[58] Field of Search ..... 428/66, 428, 433, 434, 428/913, 64; 359/551, 531, 532, 547, 515; 404/9, 13, 14

*Primary Examiner*—Alexander S. Thomas

[57] ABSTRACT

A reflective road sign made of a transparent tempered glass consisted of a cylindrical base, and a dome connected above the cylindrical base, the cylindrical base having a peripheral outside wall coated with an inner layer of light-permeable color covering, an outer layer of corrosion resisting coating, and an intermediate layer of reflective metal coating between the inner layer of light permeable color covering and the outer layer of corrosion resisting coating.

6 Claims, 4 Drawing Sheets

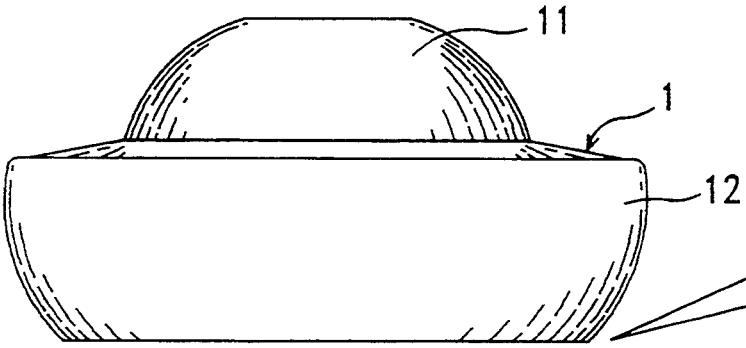
FIG.5
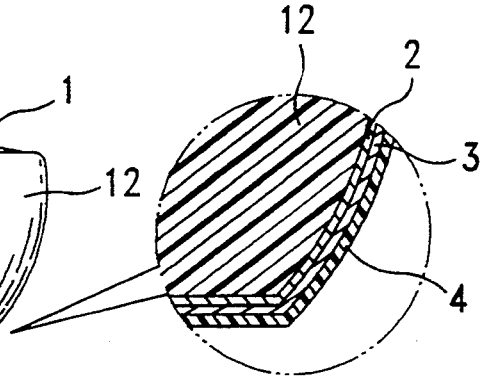
FIG.5a
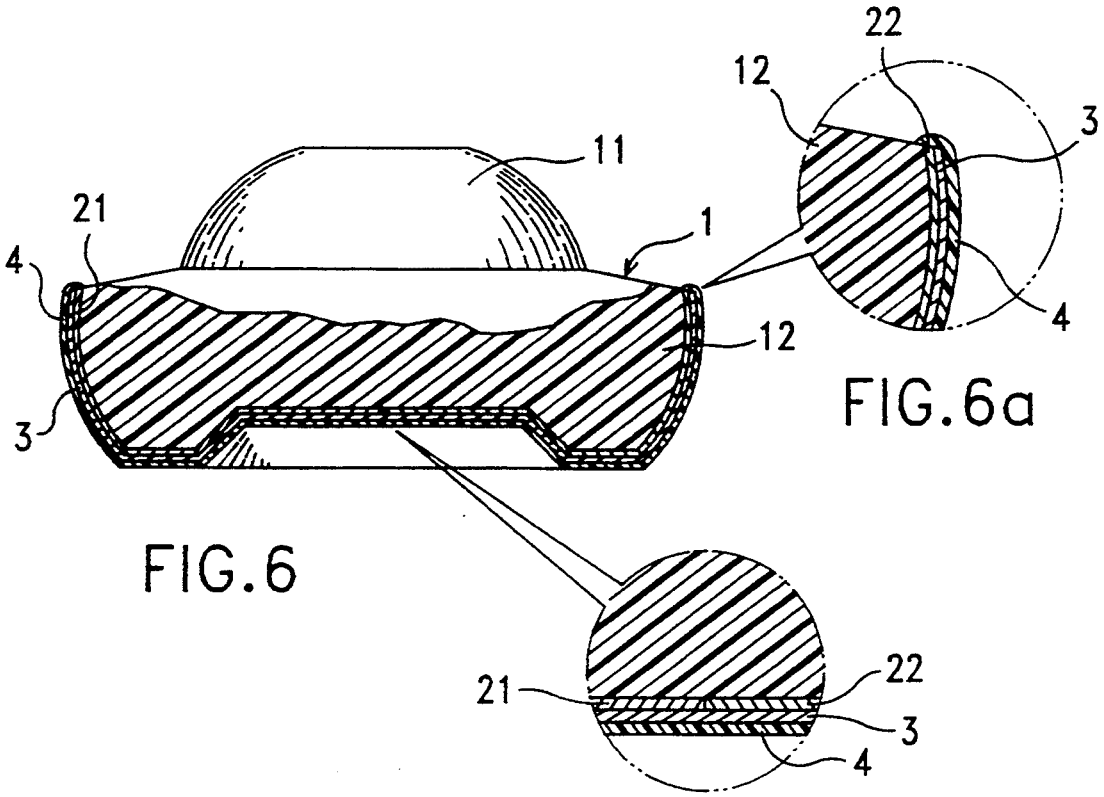
FIG.6
FIG.6a
FIG.6b

REFLECTIVE ROAD SIGN

BACKGROUND OF THE INVENTION

The present invention relates to road signs, and more particularly to a reflective road sign which has a cylindrical base covered with an inner layer of light-permeable color covering, an outer layer of corrosion resisting coating, and an intermediate layer of reflective metal coating between the inner layer of light permeable color covering and the outer layer of corrosion resisting coating for reflecting light.

Various reflective road signs are manufactured, and widely used in different roads for reflecting light and for guiding traffic in respective lanes. FIGS. 1 and 2 illustrate a reflective road sign according to the prior art which is made of a transparent tempered glass in green color having a base A coated with a layer of reflective coating B made of aluminum or aluminum alloy. This structure of reflective road sign is durable in use. However, its color can not be changed once it is made. FIGS. 3 and 4 illustrate another structure of reflective road sign according to the prior art which comprises a hollow casing C made of a tempered glass, two reflectors D fastened to the inside wall of the casing C at two opposite locations, and a packing resin E filled in the casing C. This structure of reflective road sign can only reflect light in 180° angle. Further, because a large part of the reflective road sign protrudes beyond the ground when it is installed in the road, the car will produce a big vibration when passes over the reflective road sign.

SUMMARY OF THE INVENTION

The primary object of the present invention is to provide a reflective road sign which reflects light effectively and intensively. It is another object of the present invention to provide a reflective road sign which is durable in use. It is still another object of the present invention to provide a reflective road sign which is suitable for installation in any of special road conditions. It is still another object of the present invention to provide a reflective road sign which can be arrange to reflect light in 180° or 369° angle according to different road conditions (one-way roads, two-way roads, curve roads). To achieve the aforesaid objects, a reflective road sign is made of a transparent tempered glass consisted of a cylindrical base, and a dome connected above the cylindrical base, wherein the cylindrical base has a peripheral outside wall coated with an inner layer of light-permeable color covering, an outer layer of corrosion resisting coating, and an intermediate layer of reflective metal coating between the inner layer of light permeable color covering and the outer layer of corrosion resisting coating. The present invention achieves the following advantages:

1) It is cost effective. Because the inner layer of light permeable color film reflects light in color, it is not necessary to color the whole assembly of the reflective road sign, and the color of reflection can be conveniently arranged as desired.
2) It is effective in use. Because the inner layer of light permeable color film and the intermediate layer of reflective metal coating are protected inside the outer layer of corrosion resisting coating, the light reflecting function of the reflective road sign is constantly maintained.
3) It is durable and safe in use. Because the whole body of the reflective road sign is made from a tempered glass, it has high compression strength and does not hurt the tires of the vehicles passing over.
4) It is practical in use. By covering the intermediate layer of reflective metal coating over the whole or one half of the inner layer of light permeable color film, the reflective road sign reflects light in 180° or 360° angle for different applications

BRIEF DESCRIPTION OF THE DRAWINGS

FIG. 5 is a side view of a reflective road sign according to the present invention;

FIG. 6 is a partial sectional view of the reflective road sign of FIG. 5 showing the light-permeable color covering colored in two different colors;

DETAILED DESCRIPTION OF THE PREFERRED EMBODIMENTS

Figure 1:
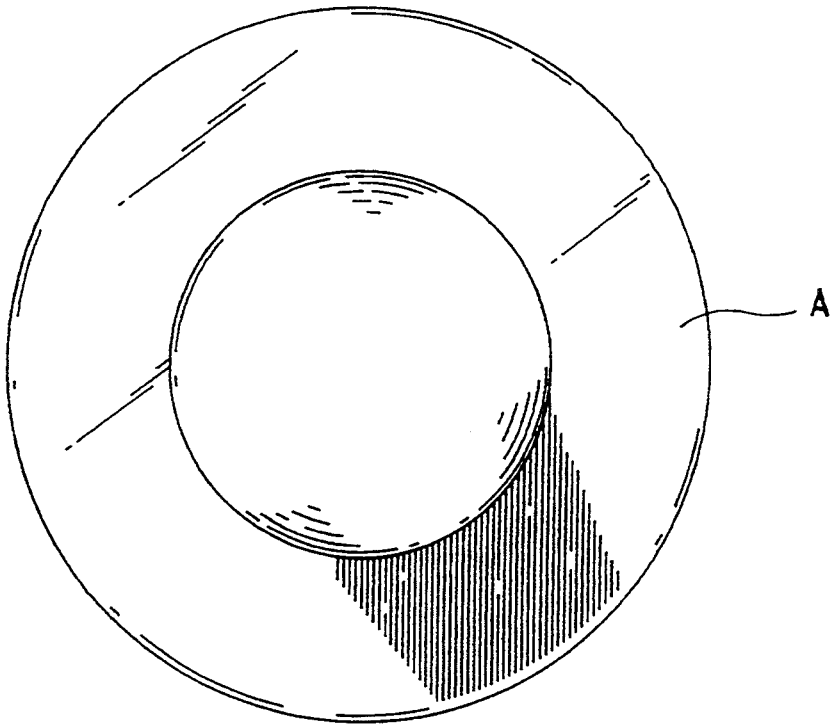
FIG. 1 is a top view of a reflective road sign according to the prior art.
Figure 2:
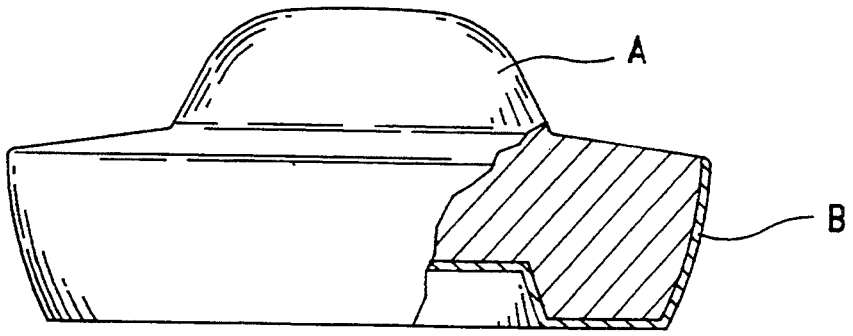
FIG. 2 is a partial sectional view of the reflective road sign shown in FIG. 1.
Figure 3:
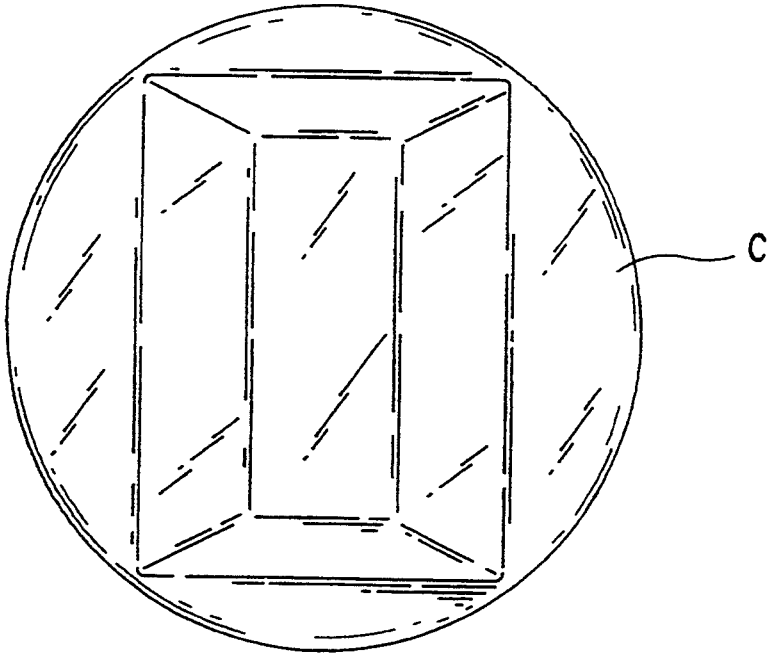
FIG. 3 is a top view of another structure of reflective road sign according to the prior art.
Figure 4:
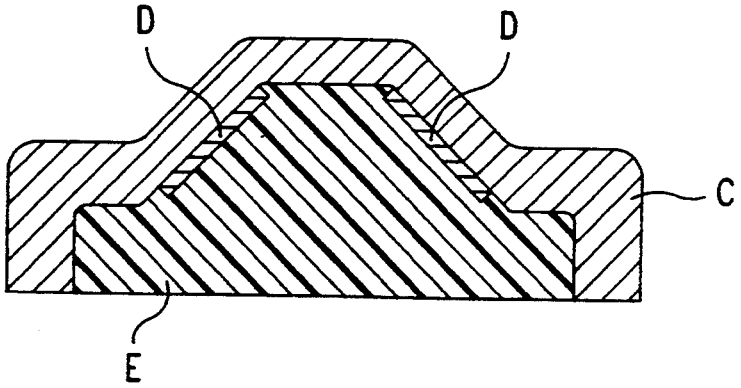
FIG. 4 is a partial sectional view of the reflective road sign shown in FIG. 3.

Referring to FIG. 5, a reflective road sign in accordance with the present invention is generally comprised of a body 1 made of a transparent tempered glass. The body 1 comprises a cylindrical base 12 having a dome 11 at the top. The cylindrical base 12 is peripherally covered with a layer of light-permeable color covering 2. A light-permeable color glass which has the same coefficient of expansion of the body 1 and made in yellow, red or any color according to the local traffic law may be covered on the base 12 to replace the light-permeable color covering 2. The light-permeable color covering 2 is uniformly colored in one color. Alternatively, the light-permeable color covering 2 may includes two halves 21;22 of different colors (see FIG. 6). A reflective metal coating 3 (which may be made of aluminum, aluminum alloy, stainless steel, or titanium)is coated over the color covering 2 on the outside. The covering area of the reflective metal coating 3 may cover the whole outside surface of the color covering 2 or half of it. If the color covering 2 has one half of the outside surface thereof covered with the reflective metal coating 3, one half of the cylindrical base 12 reflects light and the other half of it does not reflect light, namely, the angle of reflection of light of the cylindrical base 12 is 180°. A corrosion resisting layer 4 is covered over the outside surface of the reflective metal coating 3. The corrosion resisting layer 4 can be of a fluorocarbon resin paint, an epoxy resin paint, a UV (ultraviolet) rubber paint, or any other acid and alkali resisting paint. The corrosion resisting layer 4 protects the reflective metal coating 3 against weather and any of a variety of environmental pollutions. Therefore, the reflective road sign can be installed in any special area (for example, an industrial processing zone). Because the reflective metal coating 3 is completely covered by the corrosion resisting layer 4, its reflective property will not be deteriorated.

Figure 7:
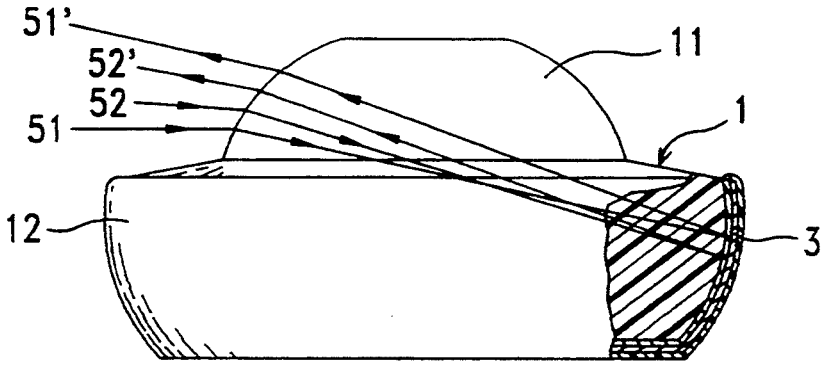
FIG. 7 is a schematic drawing of the reflective road sign of FIG. 5 showing rays of light refracted and reflected.

Referring to FIG. 7, when incident rays 51;52 pass through the dome 11 of the body 1 they become refracted to the reflective metal coating 3 and then reflected by it. Reflected rays 51;52' are then refracted to the outside through the dome 11 in a wide angle of reflection.

Figure 8:
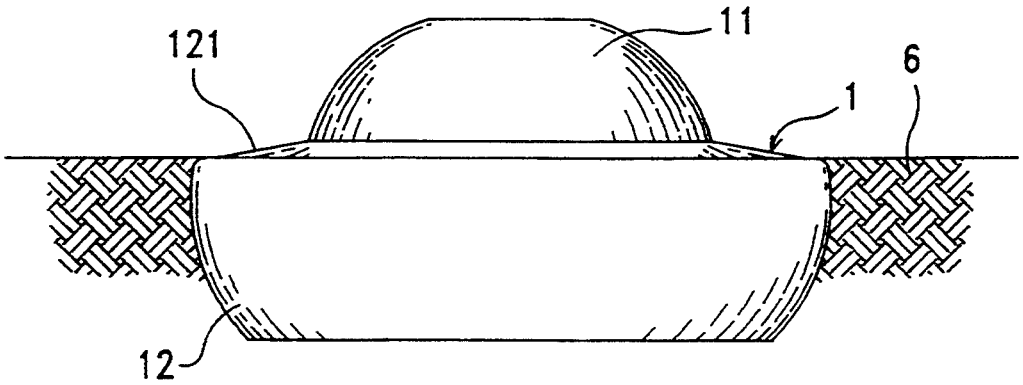
FIG. 8 is an installed view showing the reflected road sign of FIG. 5 embedded in the ground.

Referring to FIG. 8, the cylindrical base 12 of the body 1 is embedded in the ground 6 with the dome 11 and the top surface of the cylindrical base 12 disposed outside the ground 6.

What is claimed is:

1. A reflective road sign comprising a body made of a transparent tempered glass comprised of a cylindrical base, and a dome connected above said cylindrical base, wherein said cylindrical base has a peripheral outside wall coated with an inner layer of light-permeable color covering, an outer layer of corrosion resisting coating, and an intermediate layer of reflective metal coating between said inner layer of light permeable color covering and said outer layer of corrosion resisting coating.

2. The reflective road sign according to claim 1 wherein said inner layer of light permeable color covering is made of glass colored according to local traffic law, said inner layer of light permeable color covering having a coefficient of expansion same as said body.

3. The reflective road sign according to claim 1 wherein said inner layer of light-permeable color covering is consisted of two equal halves colored in different colors.

4. The reflective road sign according to claim 1 wherein said intermediate layer of reflective metal coating can be made of aluminum, aluminum alloy, stainless steel, or titanium.

5. The reflective road sign according to claim 1 wherein intermediate layer of reflective metal coating is covered on said inner layer of light permeable color covering over the lower half of said cylindrical base.

6. The reflective road sign according to claim 1 wherein said outer layer of corrosion resisting coating can be made of a fluorocarbon resin paint or an epoxy resin paint.

* * * * *